United States Patent [19]

Olson

[11] 4,026,002

[45] May 31, 1977

[54] TOOL FOR REMOVING VALVE LIFTERS

[76] Inventor: Oscar R. Olson, Route No. 2 Box 200B, Dassel, Minn. 55325

[22] Filed: June 23, 1976

[21] Appl. No.: 698,802

[52] U.S. Cl. ..... 29/280; 29/263

[51] Int. Cl.[2] ..... B25B 27/14

[58] Field of Search ..... 29/263, 255, 267, 280

[56] References Cited

UNITED STATES PATENTS

| | | | |
|---|---|---|---|
| 2,847,752 | 8/1958 | Simmons | 29/280 |
| 3,252,210 | 5/1966 | Bowden | 29/280 |
| 3,479,722 | 11/1969 | Maness | 29/280 |
| 3,611,539 | 10/1971 | Meaden | 29/263 |

*Primary Examiner*—James L. Jones, Jr.
*Attorney, Agent, or Firm*—Merchant, Gould, Smith, Edell, Welter & Schmidt

[57] ABSTRACT

A hydraulic lifter extracting tool including a gripping assembly made up of cylindrical sectors dimensioned to engage the lifter to be extracted not only axially but radially, the quadrants having a conical bore for engagement by a suitably configured actuator point.

6 Claims, 7 Drawing Figures

TOOL FOR REMOVING VALVE LIFTERS

BACKGROUND OF THE INVENTION

This invention relates to the field of tools for automobile mechanics, and particularly to a tool for extracting hydraulic valve lifters in engine overhaul.

Many modern internal combustion engines have hydraulic valve lifters located between the ends of exhaust and intake valve push rods and the cam actuated rocker arms provided to displace the valves against their springs. Removal of these lifters for inspection and replacement if necessary comprises one of the common tasks of a mechanic. The lifters are generally cylindrical and are generally retained in cylindrical openings for engaging the engine camshaft at their first ends. They are thus located well within the engine, frequently at the bottom of a push rod passage of considerable depth which traverses one or more transverse restrictions. When only a known one of these lifters requires replacement, it is advantageous to be able to do this while avoiding as far as possible the wholesale disassembly of the engine which accompanies a general overhaul. A tool which can be operated through long passages of limited cross section is thus desirable, and such tools are taught in Bowden U.S. Pat. No. 3,252,210 and Tutino U.S. Pat. No. 3,681,838, for example.

One factor requiring lifter replacement is the build-up of gum or varnish on the lifter. The same factor makes removal of the lifter difficult, and requires an extractor capable of applying considerable axial force to the lifter, even to the extent of providing an impact hammer arrangement, as is taught in Miller U.S. Pat. No. 2,943,385. When the space limitations set by the configuration of the end of the lifter which must be engaged by an extractor are considered, the problem of making an extractor small enough and yet strong enough becomes quite difficult.

SUMMARY OF THE INVENTION

The present invention comprises an extractor in which a gripping assembly is arranged so that it engages the lip of a lifter axially throughout substantially its entire circumference, and moreover engages the lifter lip radially as well. The assembly is operated by an actuator which acts in a direction opposite to that in which the extracting force is to be applied. Special embodiments of the invention are shown for use through a push rod aperture, and for use where access is more open. The extractor includes a body or outer sleeve, a multipartite gripping assembly located within the outer sleeve, an inner sleeve for limiting axial movement of the assembly, an actuator with a convex conical end for engaging concave conical cavity portions of the assembly to push them into engagement with the lifter to be extracted, and means for applying axial force to accomplish the actuator motion.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
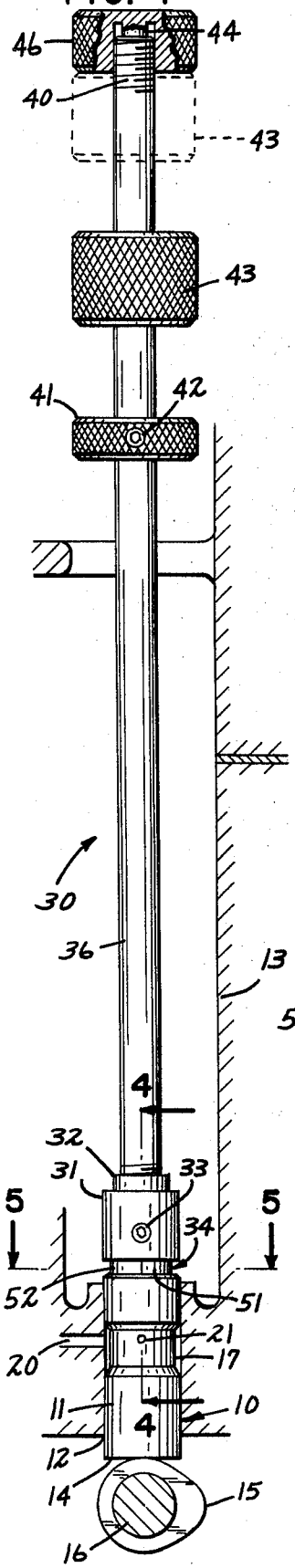
FIG. 1 is a view showing the extractor of the invention in use to extract a lifter through a push rod passage.
Figure 2:
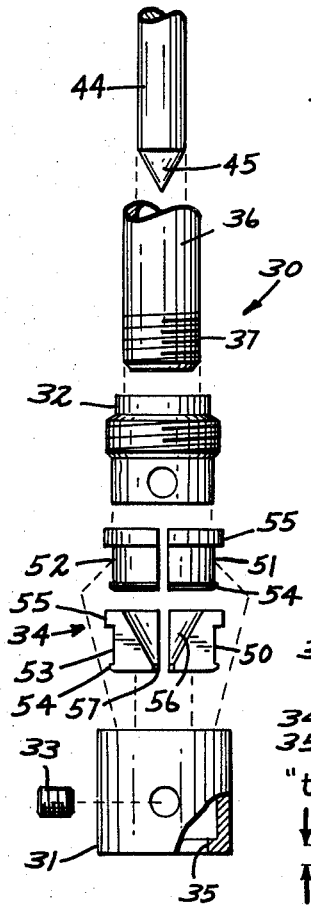
FIG. 2 is an enlarged exploded view of a portion of FIG. 1, said portion being broken away and shown in section.
Figure 3:
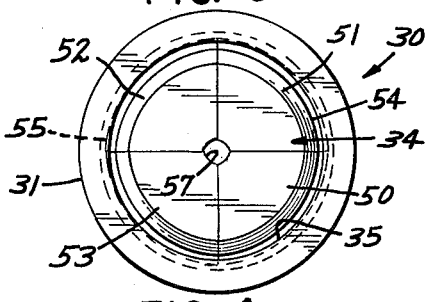
FIG. 3 is an end view of the extractor of FIG. 1, on an enlarged scale.

Referring first to FIG. 1, a hydraulic valve lifter is shown at 10 as a generally cylindrical hollow member 11 reciprocating in a passage 12 in an engine block 13. Body 11 has a first, closed end 14 arranged for engagement by a cam 15 on the engine camshaft 16, and an intermediate circumferential groove 17 receiving oil, through a passage 20, which may enter the lifter through an aperture 21.

Figure 4:
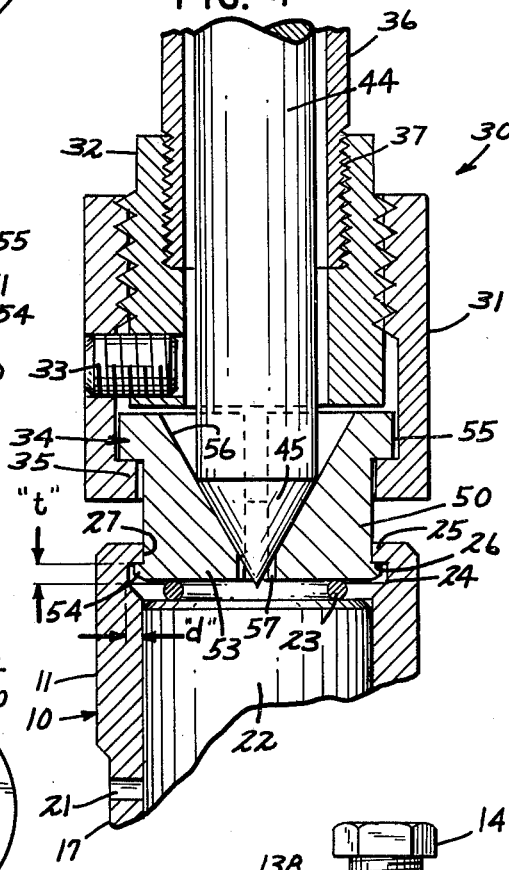
FIG. 4 is a fragmentary sectional view along the line 4—4 of FIG. 1, on a greatly enlarged scale.
Figure 5:
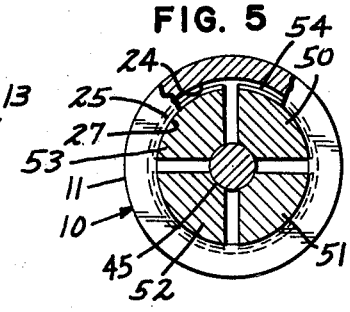
FIG. 5 is a transverse sectional view of the extractor taken along the line 5—5 of FIG. 1, on an enlarged scale.

As shown in FIG. 4, the conventional mechanism of the lifter indicated generally by the reference numeral 22 is retained in the lifter by a resilient ring 23 which is received in a groove 24 formed in body 11 in such a way as to provide an in-turned lip 25 having an axial surface 26 and a peripheral surface 27. Groove 24 is wider than the size of ring 23, so that in the absence of hydraulic pressure within the lifter there is a space *t* between surface 26 and the plane of ring 23, which space is used for extracting the lifter.

My extractor 30 is shown to comprise an outer sleeve 31 into which is threaded an inner sleeve 32, the two being secured together by a set screw 33. A gripping assembly 34 presently to be described is retained against an in-turned lip 35 at one end of sleeve 31. Sleeve 32 is extended by a tube 36 secured thereto in any suitable fashion, as by threads 37: the remote end of tube 36 is screw-threaded at 40. A hand grip 41 is secured to tube 36 as by a set screw 42, to function with tube 36 as a handle for the took, and an inertia mass 43 is slidable on tube 36.

An actuator 44 fits within tube 36: at one end the actuator is formed as a convex conical point 45, and at the other end it is fastened to a knob 46 which is internally threaded to mate with threads 40 on tube 36. Other configurations at point 45 may in some instances be acceptable. Knob 46 acts as a stop against which inertia mass 43 may impact.

Gripping assembly 35 is made up of four identical elements 50, 51, 52 and 53 in the general form of cylindrical quadrants coacting to jointly define a generally cylindrical assembly having a first out-turned ledge 54 at a first end and a second out-turned ledge 55 at a second end. It will be appreciated that another number of elements, such as 51, could be used if desired. The diameter of the cylindrical assembly at ledge 55 is greater than the diameter of sleeve 31 at lip 35. The diameter of the assembly at ledge 54 is slightly less than the diameter of lip 35, and the diameter of the assembly between the lips is still less, by an amount however which is not so great as the depth *d* of groove 24: all these dimensions are of course based on the dimensions of the lifter to be extracted, the axial dimension of ledge 54 for example being no greater than the dimension *t*.

A generally conical bore 56 tapers into assembly 34 from the second end thereof, the angle of the cone being substantially that of point 45. Since assembly 34 is conveniently made by turning the cylinder with its ledges and conical bore and then cutting the piece into quadrants along mutually perpendicular planes passing through the axis of the piece, it is understood that each quadrant may be less than complete by half the thickness of the cutting blade along each plane surface. If desired, the apex of the conical bore may be modified by a small axial cylindrical bore 57 of diameter slightly larger than the thickness of the cutting blade.

Figure 6:
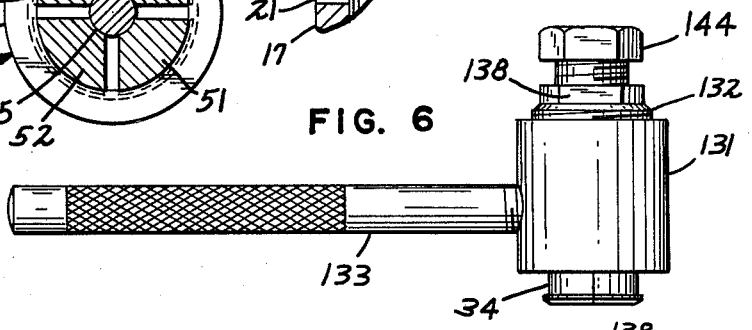
FIG. 6 is a side view of a second embodiment of the invention usable where access to the lifter is more open.
Figure 7:
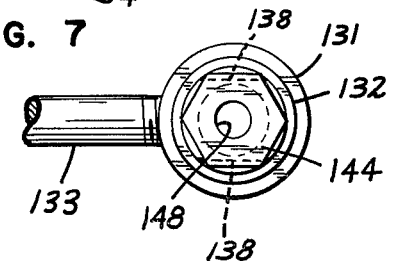
FIG. 7 is a fragmentary plan view of the structure of FIG. 6.

Turning now to FIGS. 6 and 7, a slightly different embodiment of the invention is shown to comprise an outer sleeve 131, into which is threaded an inner sleeve 132, the two being secured in adjusted position by a member 133 threaded at one end to serve as a set screw, and sized to function as a handle for the tool. Gripping assembly 134 is contained in sleeve 131, and its axial movement is limited by sleeve 132, as described in connection with the first embodiment. An actuator 144 is threaded into sleeve 132, and has a conical point to cooperate with a conical bore in the assembly. The conical point and bore are not shown, but are similar to and function like point 45 and bore 56. Member 132 is shown as provided with flats 138, for ease in assembly, and member 144 may also have flats, or may be knurled if desired. As shown in FIG. 7, member 144 may be axially bored and tapped at 148 to receive an extension, if this is found advantageous.

OPERATION

The use of my tool should now be apparent. Knob 46 is turned to release the force of point 45 against bore 56, and the tool is positioned with the ends of assembly 34 engaging ring 23 so that ledge 54 may be forced into the space *t*. Now, if knob 46 is turned in the opposite direction, point 45 engages bore 56 causing the elements of the assembly to be displaced in a radially outward direction. Ledge 54 now engages the surface 26 of lifter groove 24, and the intermediate cylindrical surfaces of the elements contact surface 27 of the lifter. Note that the engagement of the gripping elements with the lifter is not at a pair of diametrically opposed, limited areas, but continues substantially all around the lifter. Axial force may now be applied to the tool to extract the lifter.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A valve lifter extracting tool comprising, in combination:

an outer sleeve having an in-turned lip;

a gripping assembly comprising a plurality of elements in the general form of cylindrical sectors coacting to jointly define a generally cylindrical assembly, of smaller diameter than said lip, having a first out-turned ledge at a first end and a second out-turned ledge at a second end, and having a generally conical bore tapering inwardly from said second end, said first ledge being dimensioned for passing axially out of said sleeve past said in-turned lip, and said second ledge being dimensioned for retention in said sleeve axially by said lip;

an inner sleeve having one end positioned within said outer sleeve near said second end of said assembly to limit the inward axial movement thereof in said sleeve;

an actuator passing axially through said inner sleeve and having an end configured to engage said generally conical bore for causing outward radial displacement of said elements in said outer sleeve to increase the effective diameter of said assembly;

and means for causing axial movement of said actuator in said inner sleeve.

2. The structure of claim 1 together with handle means carried by at least one of said sleeves.

3. The structure of claim 1 in which the end of said actuator engaging said bore comprises a conical point, so as to increase the effective diameter of the portion of said assembly which extends beyond said lip.

4. The structure of claim 1 together with means locking said inner sleeve in position in said outer sleeve.

5. The structure of claim 1 in which the last-named means comprises a screw-threaded connection between said inner sleeve and said actuator.

6. A valve lifter extracting tube comprising, in combination:

an outer sleeve having an in-turned lip;

a gripping assembly comprising four elements in the general form of cylindrical quadrants coacting to jointly define a generally cylindrical assembly, of smaller diameter than said lip, having a first out-turned ledge at a first end and a second out-turned ledge at a second end, said first ledge being dimensioned for passing axially out of said sleeve past said in-turned lip, and said second ledge being dimensioned for retention in said sleeve axially by said lip;

an inner sleeve having one end positioned within said outer sleeve near said second end of said assembly to limit the inward axial movement of said assembly in said sleeve;

handle means from said inner sleeve axially;

an actuator passing axially through said inner sleeve and having a conical point to engage said generally conical bore for causing outward radial displacement of said elements to increase the effective diameter of said assembly;

screw-threaded means carried by said actuator and engaging said handle means for causing said axial movement of said actuator in said inner sleeve;

and means slidable along said handle means to impact on said screw-threaded means to apply axial impact to the lifter.

* * * * *